US006791527B2

(12) United States Patent
Yoshinaga et al.

(10) Patent No.: US 6,791,527 B2
(45) Date of Patent: Sep. 14, 2004

(54) LIQUID CRYSTAL DISPLAY APPARATUS AND DRIVING METHOD FOR THE LIQUID CRYSTAL DISPLAY APPARATUS

(75) Inventors: Hideki Yoshinaga, Yokohama (JP); Hideo Mori, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 238 days.

(21) Appl. No.: 09/819,681

(22) Filed: Mar. 29, 2001

(65) Prior Publication Data

US 2001/0043179 A1 Nov. 22, 2001

(30) Foreign Application Priority Data

Mar. 30, 2000 (JP) ..... 2000-094372

(51) Int. Cl.[7] ..... G09G 3/36

(52) U.S. Cl. ..... 345/102; 345/88; 345/89; 345/690; 348/268; 348/687

(58) Field of Search ..... 345/87–89, 102, 345/204–207, 690, 691; 348/687, 697, 268–270

(56) References Cited

U.S. PATENT DOCUMENTS

| | | | | |
|---|---|---|---|---|
| 4,367,924 A | | 1/1983 | Clark et al. | 350/334 |
| 5,270,848 A | | 12/1993 | Takabayashi et al. | 359/88 |
| 5,517,208 A | | 5/1996 | Mori et al. | 345/87 |
| 5,737,036 A | * | 4/1998 | Kanai et al. | 348/742 |
| 5,844,540 A | * | 12/1998 | Terasaki | 345/102 |
| 5,847,799 A | | 12/1998 | Tanaka et al. | 349/174 |
| 5,903,251 A | | 5/1999 | Mori et al. | 345/101 |
| 6,061,044 A | | 5/2000 | Ohno et al. | 345/95 |
| 6,115,016 A | * | 9/2000 | Yoshihara et al. | 345/88 |
| 6,160,605 A | | 12/2000 | Murayama et al. | 349/152 |
| 6,188,379 B1 | * | 2/2001 | Kaneko | 345/102 |
| 6,232,963 B1 | * | 5/2001 | Tew et al. | 345/204 |
| 6,285,346 B1 | * | 9/2001 | Melnik et al. | 345/87 |
| 6,333,727 B2 | * | 12/2001 | Mizumaki | 345/89 |
| 6,377,236 B1 | * | 4/2002 | Karamoto | 345/102 |
| 6,392,620 B1 | * | 5/2002 | Mizutani et al. | 345/88 |
| 6,448,951 B1 | * | 9/2002 | Sakaguchi et al. | 345/88 |

FOREIGN PATENT DOCUMENTS

| | | |
|---|---|---|
| JP | 56-27198 | 3/1981 |
| JP | 56-107216 | 8/1981 |
| JP | 9-50049 | 2/1997 |

OTHER PUBLICATIONS

M. Schadt et al., "Voltage–Dependent Optical Activity Of A Twisted Nematic Liquid Crystal", Applied Physics Letters, vol. 18, No. 4 (Feb. 15, 1971), pp. 127–128.

A.D.L. Chandani et al., "Tristable Switching in Stabilized Ferroelectric Liquid Crystals with a Large Spontaneous Polarization", Japanese Journal of Applied Physics, vol. 27, (1988), pp. L729–732.

S.S. Seomun et al., "Evolution of Switching Characteristics from Tristable to V–Shaped in an Apparently Antiferroelectric Liquid Crystal", Japanese Journal of Applied Physics, vol. 36 (1997), pp. 3586–3590.

* cited by examiner

*Primary Examiner*—Henry N. Tran
(74) *Attorney, Agent, or Firm*—Fitzpatrick, Cella, Harper & Scinto

(57) ABSTRACT

A liquid crystal display apparatus principally includes a liquid crystal display device which comprises a pair of electrodes and a liquid crystal and is driven in a succession of frame periods by applying a voltage to the pair of electrodes, a light source capable of emitting light while changing a lighting duty in a frame period, and control means for controlling the light source so as to provide a constant time-integrated luminance in each frame period over the succession of frame periods regardless of the change in lighting duty.

6 Claims, 6 Drawing Sheets

LIQUID CRYSTAL DISPLAY APPARATUS AND DRIVING METHOD FOR THE LIQUID CRYSTAL DISPLAY APPARATUS

FIELD OF THE INVENTION AND RELATED ART

The present invention relates to a liquid crystal display apparatus using a liquid crystal device as a light value for use in flat-panel displays, projection displays, etc., and a driving method for the liquid crystal display apparatus.

A twisted nematic (TN) liquid crystal has widely been used conventionally as a material for flat-panel displays as described by M. Schadt and W. Helfrich, "Applied Physics Letters", Vol. 18, No. 4 (Feb. 15, 1971), pp. 127–128. The TN liquid crystal is used in an active matrix-type liquid crystal device (panel) in combination with switching elements such as thin film transistors (TFTs). The active matrix-type liquid crystal device is free from a problem of cross-talk since each pixel is provided with a switching element and is produced with high productivity with respect to that having a size (diagonal length) of 10–17 in. with quick a progress of production technique in recent years.

However, the above-mentioned liquid crystal device using the TN liquid crystal has been accompanied with problems such as a slower response speed and a narrower viewing angle in order to well display clear motion (picture) images.

In order to solve the problems, various alignment modes including an optically compensated bend or birefringence (OCB) mode for improving a response speed, and In-Plain Switching mode and MVA (Multi-domain Vertical Alignment) mode for improving a viewing angle have been developed and proposed.

Further, in order to solve the problems of the conventional TN liquid crystal devices, a liquid crystal device using a chiral smectic liquid crystal exhibiting bistability has been proposed by Clark and Lagerwall (Japanese Laid-Open Application (JP-A) 56-107216, U.S. Pat. No. 4,367,924). As the liquid crystal exhibiting bistability, a ferroelectric liquid crystal having chiral smectic C phase (SmC*) or H phase (SmH*) is generally used. Such a ferroelectric liquid crystal provides a very quick response speed because it causes inversion switching of liquid crystal molecules based on their spontaneous polarizations. In addition, the ferroelectric liquid crystal assumes bistable state showing a memory characteristic.

In recent years, an anti-ferroelectric liquid crystal exhibiting tristable state has been proposed by (chandani, Takezoe et al. ("Japanese Journal of Applied Physics", vol. 27 (1988), pp. L729-). The anti-ferroelectric liquid crystal also provides a very quick response speed similarly as in the ferroelectric liquid crystal.

As another type of the anti-ferroelectric liquid crystal, there has been recently proposed a chiral smectic liquid crystal providing a V-character shaped response characteristic (voltage-transmittance characteristic) which is advantageous for gradational image display and is free from hysteresis (e.g., "Japanese Journal of Applied Physics", Vol. 36 (1997), pp. 3586-). Further, an active matrix-type liquid crystal device using such a chiral smectic liquid crystal providing the V-shaped voltage-transmittance characteristic has also been proposed (JP-A 9-50049).

As described above in order to provide a liquid crystal display apparatus with a high-speed responsiveness and a good gradational display characteristic, liquid crystal displays of the above-mentioned OCB-mode and anti-ferroelectric liquid crystal materials have been extensively researched and developed more popularly than ever.

Further, with the development of high-speed liquid crystal device, another color liquid crystal device (scheme) has been proposed.

Generally, a conventional color liquid crystal display apparatus (device) comprises a pair of substrates between which color filters of red (R), green (G) and blue (B) and a liquid crystal are disposed and includes a plurality of pixels each comprising a set of color pixels (sub-pixels) of R, G and B which transmittances are independently controllable. Specifically, the transmittances of the color pixels (R, G, B) are controlled for each color pixel at each corresponding portion of the liquid crystal or in combination with a pair of polarizers, thus ordinarily displaying color images according to the additive process of R, G and B. In that case, as a light source, a transmission-type backlight (unit) emitting white light or a reflection-type light source utilizing an external light may be applicable but their display principals of color space are identical to each other.

Such a color liquid crystal display apparatus is, however, accompanied with a lower efficiency of utilizing light. For example, a white color image is displayed based on the additive process of R, G and B by color-mixing ⅓ (as a wavelength region) of Red (red)-light flux, ⅓ of G (green)-light flux, and ⅓ of B (blue)-light flux, on the basis of light fluxes entering the R-color filters spatially occupying ⅓ of all the incident light. Accordingly, an efficiency of light utilization is merely ⅓ before the incident light enters the liquid crystal layer. This means that a larger power consumption is required of the backlight occupying a major part of all the power consumption of the liquid crystal display apparatus.

Further, for each pixel, three color pixels have to be driven independently. As a result, it becomes difficult to effect a pixel design with an increasing definition, thus lowering an opening rate leading to light utilization efficiency. In addition, from the viewpoint of production costs, the above-mentioned color liquid crystal display apparatus is required to use driver ICs and color filters each with larger bits which are constraint factors to the cost of the liquid crystal display apparatus, thus being disadvantageous.

In view of these circumstances, another type of a color liquid crystal display apparatus has been developed extensively. Particularly, a color liquid crystal display apparatus using a backlight-color switching system as described in JP-A 56-27198 has been actively studied. According to the backlight-color switching system, the color of illumination light (backlight) is switched within a time period of at most the flicker frequency and in synchronism therewith, a (light-)transmission state of the liquid crystal panel is controlled to realize color reproduction by using the spatial additive process. The switching system is also called a RGB field sequential display scheme or field sequential color scheme.

FIG. 6A shows an embodiment of a light emission state at a pixel of a hold-type liquid crystal display apparatus and FIG. 6B shows an embodiment of a light emission state at a pixel of an impulse-type display apparatus.

Referring to FIG. 6A, most of the liquid crystal display apparatus, when a certain pixel is placed in a light emission (open) state, the pixel holds a relatively constant luminance until a subsequent field period (frame period), thus continuing display. On the other hand, in a CRT display of an impulse-type as shown in FIG. 6B, a change in light emission with time is caused instantaneously to provide a high luminance. As a result, at a certain pixel, an instantaneous light emission state is observed one time within one field. At that time, the light emission period varies depending on a characteristic and a resolution of the CRT used.

In the impulse-type liquid crystal display apparatus, when a display image in n-th frame period is changed to that in n+1-th frame period, a sufficient non-display period is ensured before and after the light emission for each frame, thus obtaining displayed data smoothly on the retina.

On the other hand, in the case of the hold type liquid crystal display apparatus, however, even when the liquid crystal device used has a quick response speed, a display image in n-th frame is continuously displayed immediately before the n-th frame period is changed to n+1-th frame, thus leading to blur at an image contour portion or a judder disturbance (such a phenomenon that movement of the image becomes jerky and is observed unnaturally).

Accordingly, although the image deterioration due to double display (simultaneous display) over plural frames can be obviated by the use of a liquid crystal device with a high response speed, the blur at an image contour portion and/or the judder disturbance due to double image (continuous display) resulting from persistence of residual light (or afterglow) on the retinas (human eyes) cannot be removed.

In order to obviate the difficulties, a display period percentage (display duty) (a percentage of a display period to the display period and a non-display period) of the liquid crystal display device via the light source constituting the liquid crystal display apparatus is lowered to provide a non-display period, thus allowing cancellation of image data in a previous frame remaining on the retina to improve clearness of motion images.

In order to decrease the display duty, for example, a lighting period percentage (lighting duty) (a percentage of a lighting period to the lighting period and an extinction (turn-off) period) of the light source per se is lowered to ½ by driving the liquid crystal panel (device) at a double speed. As a result, the display duty is also lowered to ½, thus allowing display of clear motion images.

However, the lowering in display duty is accompanied with a problem in terms of display luminance.

Specifically, in the case where a cold cathode tube or an LED (light emitting diode) device allowing high-speed responsiveness is used as a light source for a liquid crystal display apparatus, it is possible to turn off the light in an extinction period, thus resulting in a substantially equal light utilization efficiency. On the other hand, a luminance allowing display or a time opening rate in the liquid crystal display apparatus is lowered depending or the display duty. As a result, in order to realize a display luminance obtained at least at a display duty of 100%; it is necessary to increase a luminance of the light source although the luminance of the light source varies depending on use or specification of the liquid crystal display apparatus.

As a means for increasing the light source luminance, an increase in number of light source unit may be considered. However, the increase of light source unit is accompanied with problems such as increase in space and cost.

As another means, it is possible to increase the light source luminance by increasing a driving current of the light source. Generally, the cold cathode tube or LED as the light source is liable to lower its luminous efficiency (in terms of power consumption) due to high-luminance emission of light except for light with a wavelength above 600 nm.

FIG. 7A is a graph showing a relationship between a relative luminance and a forward current of a LED-type light source and FIG. 7B is that of a cold cathode tube-type light source.

Referring FIG. 7A, four curves indicate current-luminance characteristics of respective color light sources of four colors (red, green, blue and white). The white light source corresponds to a light source emitting a white light obtained by color-mixing lights of red, green and blue. Herein, a maximum value of the relative luminance of white light source (i.e., 3.0 at 100 mA) is defined as a "maximum luminance". When a luminous efficiency of the white light source (slope of the curve thereof) up to ca. 20% of the maximum luminance (i.e., up to the relative luminance of ca. 0.6) is taken as 100%, the white light source will provides a relative luminance of 5.0 by extrapolation at the luminance efficiency of 100%. In this case, the white light source (with the luminance efficiency of 100%) requires a forward current of 30 mA for a relative luminance of 1.5 (50% of the maximum luminance). However, the white light source used merely provides a relative luminance of 1.2 at 30 mA, thus resulting in a luminance efficiency of ca. 80% ($^{1.2}/_{1.5}$). Further, the white light source at the maximum luminance provides a luminous efficiency of ca. 60% ($^{3.0}/_{5.0}$). As a result, it has been found from FIG. 7A that the luminous efficiency in terms of power consumption is liable to be lowered with an increasing relative luminance (i.e., with the approach of the maximum luminance).

Further, as shown in FIG. 7B, in order to obtain 50% of a maximum luminance, a forward (tube) current is ca. ¼ of that required for providing the maximum (relative) luminance.

As described above, in the case where a current providing a maximum luminance is caused to pass through a light source allowing display with high-speed emission of light, when the light source is used in such a state that light emission is performed at a maximum luminance, it is possible to improve a resultant luminance level but the light source is accompanied with a problem regarding power consumption.

SUMMARY OF THE INVENTION

An object of the present invention is to provide a liquid crystal display apparatus improved in quality of motion (picture) images while suppression power consumption.

Another object of the present invention is to provide a driving method for the liquid crystal display apparatus.

According to the present invention, there is provided a liquid crystal display apparatus, comprising:

- a liquid crystal display device which comprises a pair of electrodes and a liquid crystal and is driven in a succession of frame periods by applying a voltage to the pair of electrodes,
- a light source capable of emitting light while changing a lighting duty in a frame period, and
- control means for controlling the light source so as to provide a constant time-integrated luminance in each frame period over the succession of frame periods regardless of the change in lighting duty.

In the liquid crystal display apparatus of the present invention, the apparatus further comprises motion detection means for effecting judgment and detection as to whether an inputted digital image signal is for a still image or an motion image, and the control means may preferably comprise light source lighting duty selection means for setting the lighting duty of the light source to 100% when the inputted digital image signal for the still image is detected through the judgment and for setting the lighting duty of the light source to a lower value when the inputted digital image signal for the motion image is detected.

Further the liquid crystal display apparatus of the present invention may preferably comprise motion detection means for effecting judgment and detection as to whether an inputted digital image signal is for a still image or a motion image and a luminance detection means for detecting and comparing an average luminance level over an entire picture area of the liquid crystal display device with a luminance level at a portion where a motion detection of the motion image is effected based on the inputted digital image signal by the motion detection means; and the control means may preferably comprise light source lighting duty selection means for setting a lighting duty of the light source. In this case, based on a result of comparison by the luminance detection means, the lighting duty may preferably be set to a prescribed value by the light source lighting duty selection means.

In a preferred embodiment, the liquid crystal display apparatus may desirably comprise a motion detection means for effecting judgment and detection as to whether an inputted digital image signal is for a still image or a motion image and a luminance detection means for detecting and comparing an average luminance level over an entire picture area of the liquid crystal display device with a luminance level at a portion where detection to a larger degree of movement is effected based on the inputted digital image signal by the motion detection means. In this case, the lighting duty may preferably be set to a lower value with a larger change in luminance between the average luminance level and the luminance level at the portion.

In the liquid crystal display apparatus of the present invention, the liquid crystal display device may preferably be free from a color filter and the light source is capable of emitting three primary colors in synchronism with the liquid crystal display device, and the liquid crystal display apparatus may preferably comprise a planar-sequential color liquid crystal display apparatus for effecting color display according to a field-sequential color scheme in which one frame includes a display period for switching respective colors of the primary colors of the light source in a time sequential manner and is divided into a plurality of fields for controlling transmission and reflection states of the liquid crystal display device in synchronism with the switching of the colors of the light source, thereby to effect color display based on a timewise additive process.

The liquid crystal display apparatus of the present invention may preferably comprise a modulation means for modulating an extraction rate of color-mixing signals. In this case, the lighting duty may preferably be set to a prescribed value by adjusting the modulation means.

The liquid crystal display apparatus may preferably comprise a motion detection means, a luminance detection means, a modulation means and a selector means. In this case, the selector means may preferably effect switching between an automatic mode for determining the lighting duty by judgment as to a still image and a motion image based on a digital image signal inputted by the motion detection means and the luminance detection means and a manual mode for charging the lighting duty by adjusting the modulation means.

In the liquid crystal display apparatus of the present invention, the liquid crystal display device may preferably display an image in a frame period divided into three field periods when an inputted digital image is for a still image and in a frame period divided into at least four field periods when an inputted digital is for a motion image, and the light source may preferably control its lighting state in one frame period so that lighting is effected in a set of three field periods consisting of a red field period, a green field period and a blue field period and the frame period includes an extinction period other than the three field periods.

According to the present invention, there is also provided a driving method for a liquid crystal display apparatus, comprising:

driving a liquid crystal display device comprising a pair of electrodes and a liquid crystal disposed therebetween by applying a voltage to the pair of electrodes in a succession of frame periods, turning on a light source capable of emitting light while changing a lighting duty in a frame period, and controlling the light source so as to provide a constant time-integrated luminance in each frame period over the succession of frame periods regardless of the change in lighting duty.

According to the liquid crystal display apparatus of the present invention, it becomes possible to display an image at a desired display duty by changing appropriately the display duty depending on image data as to whether the display image is a motion image or a still image. Further, a display luminance of the liquid crystal display apparatus is controlled by making reference to a display luminance at a minimum display duty. As a result, e.g., it is possible to effect display with a constant luminance in time integration value even when the display duty is changed.

When data writing in a liquid crystal panel (device) is performed according to the raster scanning (sequential writing) scheme or when color display is performed according to the planar sequential scheme, timing of lighting of the light source is controlled in synchronism with the drive of the liquid crystal panel according to the raster scanning scheme or the planar sequential scheme, thus ensuring a constant display luminance irrespective of the display duty.

Further, when the still image is displayed, a display study at that time is 100%. At that time, a luminance level of the light source is ½ of that in a maximum light emission state, thus resulting in ca. 3/10 of power consumption. Accordingly, a luminous efficiency is increased up to 1.66 ((½)×(10/3)) times that in the maximum light emission state.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the liquid crystal display apparatus of the present invention and the driving method for the liquid crystal display apparatus will be described based on several preferred embodiments with reference to the drawings.

First Embodiment

Figure 1:
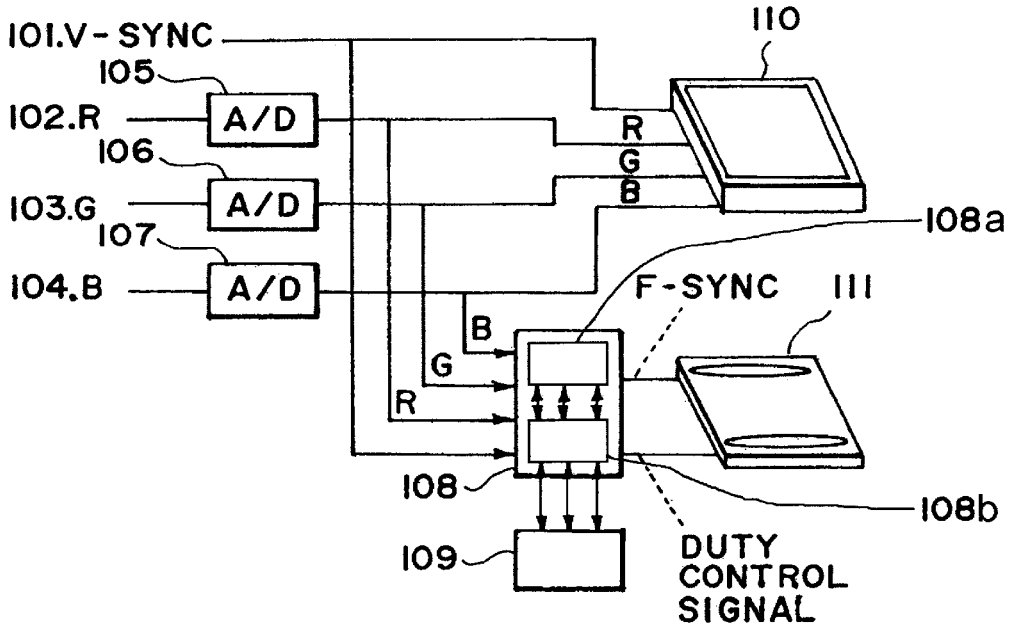
FIG. 1 is a block diagram of a color liquid crystal display apparatus as First Embodiment of the liquid crystal display apparatus according to the present invention.

FIG. 1 is a block diagram of a color liquid crystal display apparatus according to this embodiment and shows a sequence of display operations wherein a display duty of a light source is changed, as desired, depending on inputted color image signals to effect full-color image display with a high efficiency.

Referring to FIG. 1, inputted component video signals comprises a red (R) signal, a green (G) signal and a blue (B) signal. The R signal is inputted from an input terminal 102 and subjected to digital conversion by an analog/digital (A/D) converter 105. Similarly, the G signal and the B signal are inputted from input terminals 103 and 104, respectively, and subjected to digital conversion by A/D converters 106 and 107, respectively.

A synchronizing signal V-Sync is inputted from an input terminal 101.

The respective R, G and B digital signals outputted from the A/D converters 105, 106 and 107, respectively, are supplied to a motion detection circuit 108 and a color liquid crystal display device (panel) 110, respectively.

Similarly, the synchronizing signal V-Sync is also supplied to the motion detection circuit 108 and the color liquid crystal display device 110, respectively.

The luminance and motion detection circuit 108 comprises a luminance detection means (circuit) 108*a* and a motion detection means (circuit) 108*b* and is provided with a frame memory 109, thus effecting detection of the luminance and the motion of the inputted RGB digital signals. For example, luminance detection is performed only when a change in motion as to the inputted signals is detected compared with a previous frame. The luminance detection mean 108*a* detects a luminance level over the entire frame and the motion detection means 108*b* detects a luminance level of data which are not correlated with those in a preceding frame.

When the movement of high-luminance image or the movement at a high-contrast image portion is observed based on data obtained through the motion detection circuit 108, blur or bluntness of image edges are liable to occur. For this reason, in the case where no motion is detected by the motion detection means (i.e., a still image data causing no blur is supplied), a duty control signal corresponding to a light source is supplied to a light source unit 111 by a light source lighting duty selection means.

Further, when a certain image data detected by the motion detection means (circuit) as a motion image is first detected to have a lower luminance level over the entire frame but then detected to have a higher luminance level as to data irrespective of preceding frame data (i.e., when a white images moves on a black background), a duty control signal corresponding to a lighting duty unit 111 by the light source display duty selection means.

Similarly, also in the reverse case, i.e., when a black image moves on a white background, a duty control signal corresponding to the display duty of 50% is supplied to the light source unit 111 by the light source lighting duty selection means.

As described above, when a difference in luminance between a luminance level over the entire frame detected by the luminance detection means and a luminance level as to data irrespective of the preceding frame data is larger, the duty control signal is supplied to the light source unit 111 so as to provide a lower display duty (corresponding to a predetermined minimum display duty, i.e., a display duty of 50% in this embodiment).

In the color liquid crystal display device 110, the inputted digital signals is converted into analog signals by driver ICs (not shown) for the liquid crystal display device to display color images based on timing of the synchronizing signal V-Sync and the duty control signal, lighting of the light source is effected.

Figure 3A:
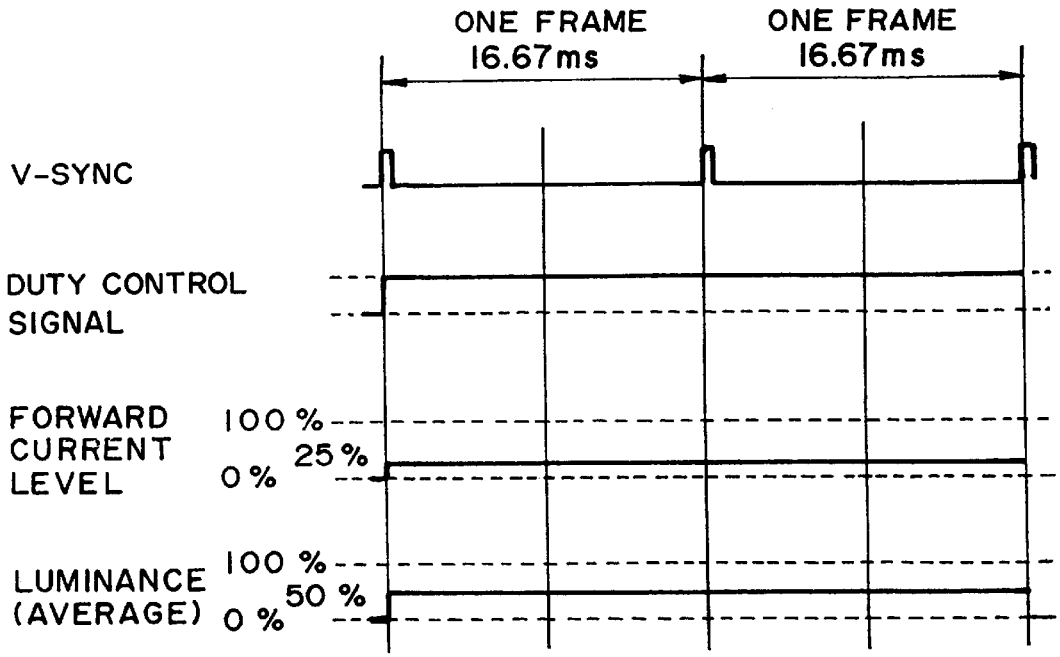
FIGS. 3A and 3B are respectively a time chart of driving waveforms for a light source and drive states for white display state of a color liquid crystal device at a display duty of 100% (FIG. 3A) and a display duty of 50% (FIG. 3B).

FIG. 3A is a time chart of driving waveforms when a display duty of the inputted duty control signal is 100% and drive states of the color liquid crystal display device at a white display portion.

Referring to FIG. 3A, as described above, the light source luminance at a display duty of 100% is determined by reference to a luminance obtained at the minimum display duty (of 50%) as a reference luminance. If a luminance of the light source in a lighting state providing a maximum luminance is taken as a reference luminance, a luminance required to be given by the light source at the time of lighting with the display duty of 100% is 50% as an average luminance (Lave.).

In view of characteristic of the light source (a relative luminance-forward current characteristic), a light source providing a higher luminance results in a lower luminous efficiency. In other words, by the use of a lower luminance as the light source luminance, it becomes possible to utilize the light source at a higher luminous efficiency.

In this embodiment, the resultant luminance is not changed depending on a change in display duty. On the other hand, a power consumption of the light source becomes ca. 3/10 when compared with the case of display duty of 50%.

Figure 3B:
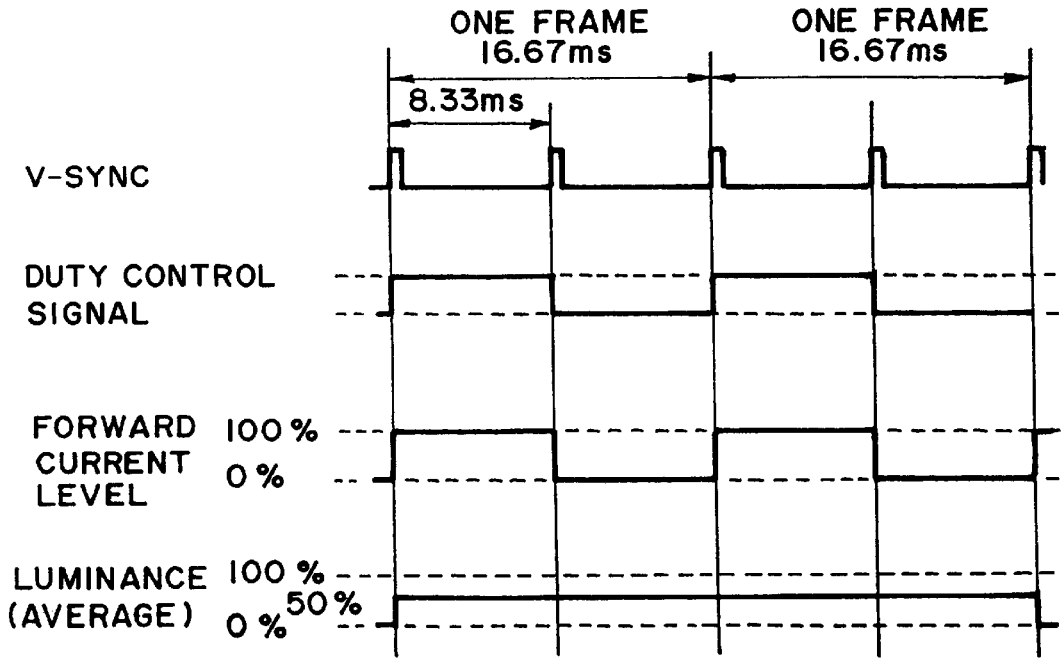

FIG. 3B is a time chart for driving waveforms when a display duty of the inputted control signal is 50% and drive states of the color liquid crystal display device.

Referring to FIG. 3B, the display operations are basically identical to the case of display duty of 100% (FIG. 3A). In this case, however, lighting of the light source is performed at a display duty of 50% based on timing of the synchronizing signal V-Sync and the duty control signal. Specifically, in the lighting period, a luminance of the light source is almost maximum but in each frame (one frame), an extinction (turn-off) period of 8.33 msec (f=60 Hz) is present.

As a result, the display scheme (FIG. 3B) approaches to the impulse display scheme, thus allowing cancellation of previous frame data remaining on the retina. Further, the holding period is shortened, whereby a smooth movement of eyes between adjacent frames, thus allowing clear motion image display with sharp image edges.

As described above, according to the above-mentioned embodiment (First Embodiment), by a combination of the color liquid crystal display device (panel) with the light source unit, images with a higher luminance and a higher contrast which are liable to provide bluntness and/or poor clearness at image edges of motion images are displayed in a non-hold mode by decreasing the display duty. Further, by modulating the display duty depending on images to be displayed, it is possible to reduce power consumption while retaining clearness with respect to motion images.

Second Embodiment

Figure 2:
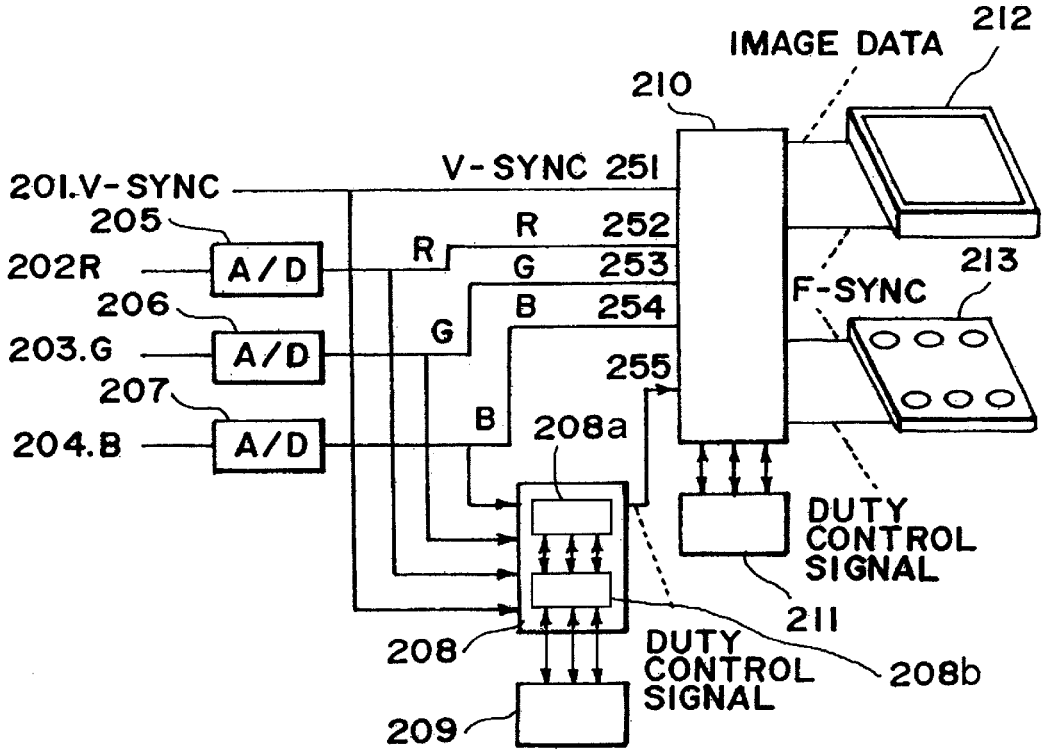
FIG. 2 is a block diagram of a color liquid crystal display apparatus driven by the planar sequential scheme used in Second Embodiment of the liquid crystal display apparatus of the present invention.

FIG. 2 shows a block diagram of a planar-sequential color liquid crystal display apparatus according to this embodiment as the liquid crystal display apparatus of the present invention and shows a sequence of display operations.

Referring to FIG. 2, a synchronizing signal V-Sync is inputted from an input terminal 201 and component video signals including a red (R) signal, a green (G) signal and a blue (B) signal are inputted from an input terminal 202 for R signal, an input terminal 203 for G signal and an input terminal 204 for B signal, respectively, and are subjected to digital conversion by A/D converters 205, 206 and 207, respectively.

The synchronizing signal V-Sync inputted from the input terminal 201 and the RGB digital signals outputted from the A/D converters 205, 206 and 207 are supplied to a P/S (parallel/serial) conversion time-division (shared) circuit 210 and a motion detection circuit 208, respectively.

In the luminance and motion detection circuit 208 (which includes a luminance detection means (circuit) 208*a* and a motion detection means (circuit) 208*b* and is provided with a frame memory 209), similarly as in the luminance and motion detection circuit 108 as shown in FIG. 1, based on the inputted RGB digital signals, detections of luminance and motion of inputted images are effected. Thereafter, a duty control signal outputted from the luminance and motion detection circuit 208 to the P/S conversion time division circuit 210 and then outputted to a light source unit 213.

The digital signals inputted in parallel form into input terminals 251 to 255 are outputted in serial form via a memory 211 based on a display duty of the duty control signal inputted from the input terminal 255. For example, when a display duty of the inputted duty control signal is 50% (for motion image), respective R/G/B/R/G/B signals are subjected to time-division multiplexing to be supplied as six-fold speed signals to a monochromatic (color filter-less) liquid crystal display device 212. Further, when a display duty of the duty control signal is 100% (for still image), respective R/G/B signals are subjected to time-division multiplexing to be supplied as three-fold speed signals to the color filter-less liquid crystal display device 212.

The synchronizing signal V-Sync supplied from the input terminal 251 is formed in synchronizing signals F-Sync, which are separated synchronously and supplied to the color filter-less liquid crystal display device 212 and the light source unit 213, respectively.

In the color liquid crystal display device 212 shown in FIG. 2, the inputted three- or six-fold speed digital signals are converted into analog signals by driver ICs (not shown) of the display device 212, thus displaying monochromatic images based on timing of the synchronizing signal F-Sync. Specifically, in divided R/G/B field periods (three field periods) for three-fold speed signals in one frame period or in divided R/G/B/R/G/B field periods (six field periods) for six-fold speed signals in one frame period, respective images for respective field periods are sequentially displayed.

In the light source unit 213, light source control signals for respective colors are formed based on the inputted synchronizing signal F-Sync and based on timing of the thus-formed light source control signals, lighting of three-color light sources is performed.

Figure 4A:
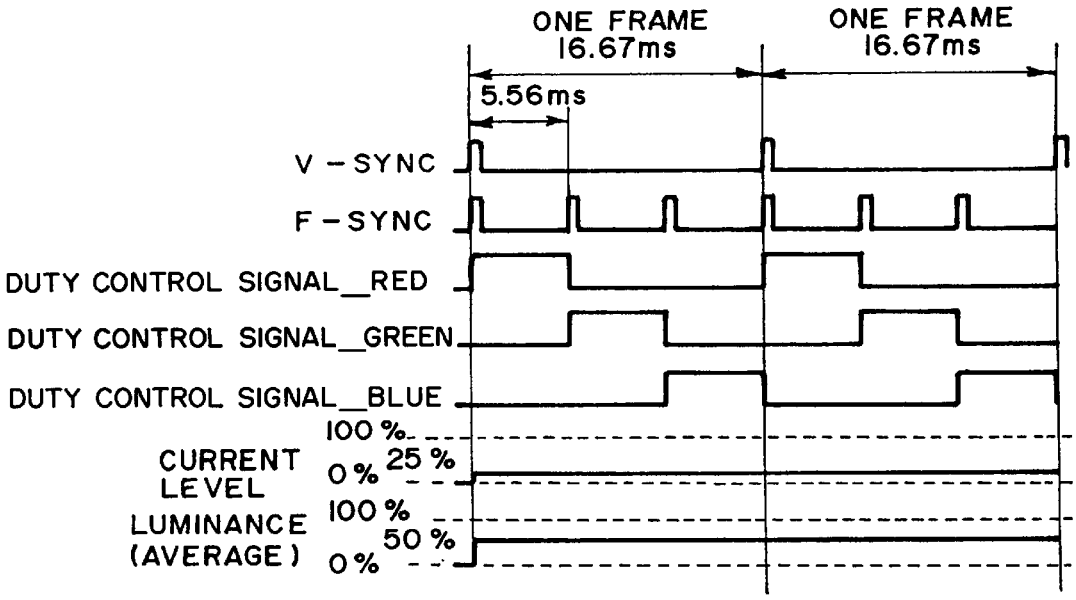
FIGS. 4A and 4B are respectively a time chart of driving waveforms for three color light sources (R, G, B) and drive state, for white display state of a color filter-less color liquid crystal device at a display duty of 100% (FIG. 4A) and a display duty of 50% (FIG. 4B).
Figure 4B:
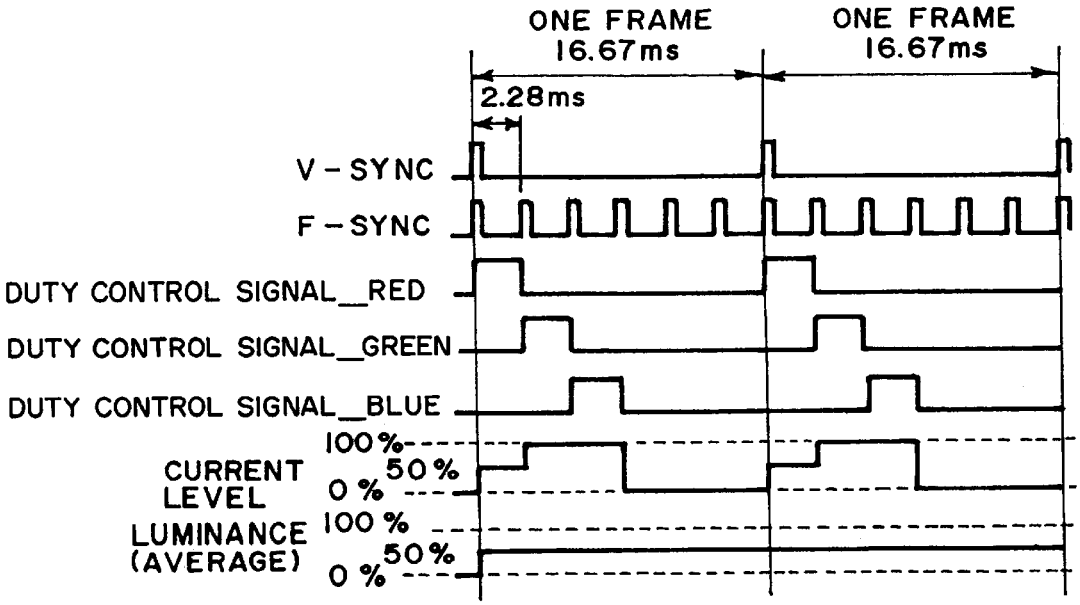

FIGS. 4A and 4B are respectively a time chart of driving waveforms when a display duty of the inputted duty control signal is 100% (FIG. 4A) or 50% (FIG. 4B) and drive states of the color filter-less liquid crystal display device at a white display portion.

Referring to FIG. 4A, as described above, the light source luminance at a display duty of 100% is determined by reference to a luminance obtained at the minimum display duty (of 50% in this embodiment) as a reference luminance. If a luminance of the light source in a lighting state providing a maximum luminance is taken as a reference luminance, a luminance required to be given by the light source at the time of lighting with the display duty of 100% is 50% as an average luminance (Lave.).

Figure 7A:
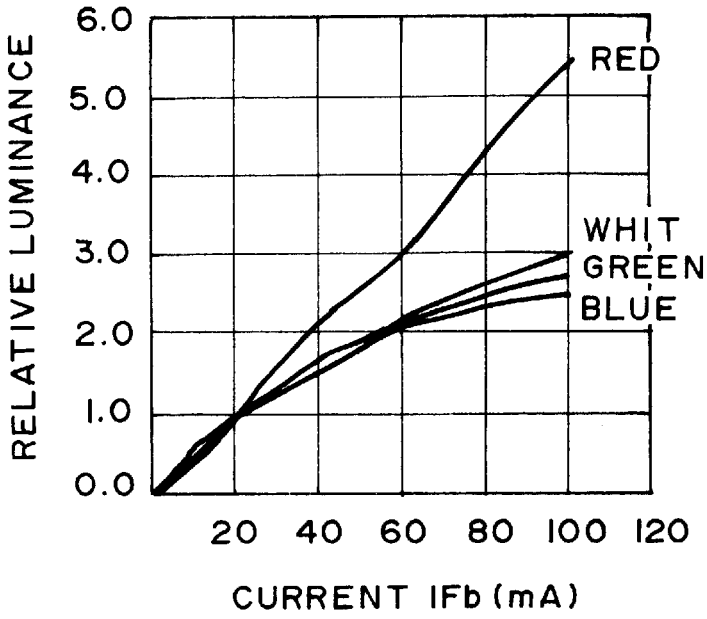
FIG. 7A shows an embodiment of a relationship between a forward current and a relative luminance of an LED-type light source and FIG. 7B shows an embodiment of that of a cold cathode tube-type light source.
Figure 7B:
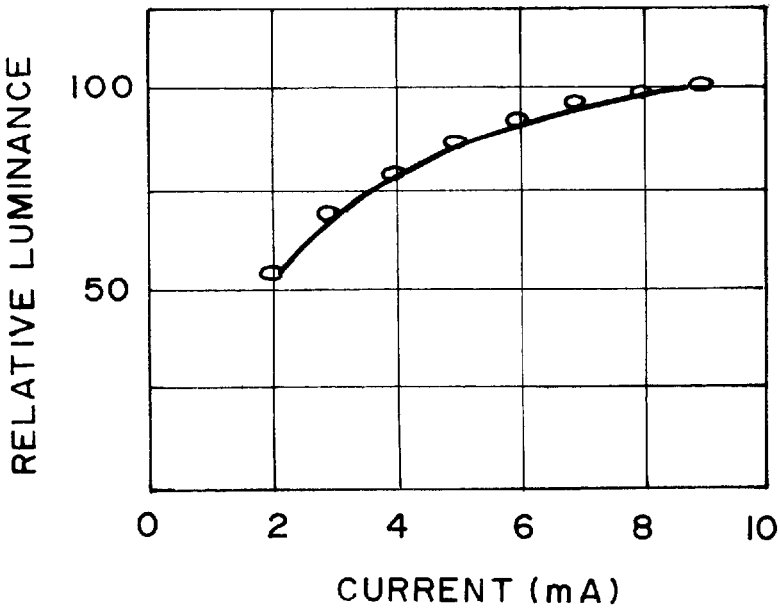

As a result, as shown in FIG. 7(*a*), when the light source provides a lighting luminance of 50% (as Lave.) at the display duty of 100%, it becomes possible to effect lighting with high luminous efficiency while suppressing the power consumption in the light sources other than the R light source.

Further, when still image is displayed, the RGB field sequential scheme is employed. As a result, a horizontal/vertical frequency is lowered to one for three-fold speed signals, thus further effectively reducing the power consumption.

Third Embodiment

Figure 5A:
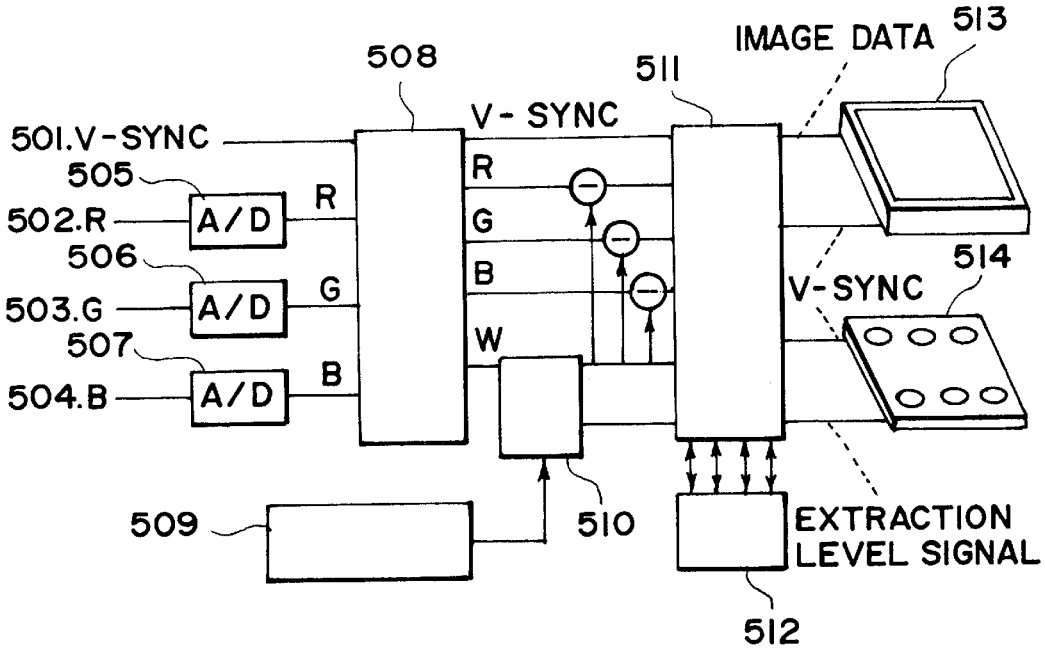
FIG. 5A is a block diagram of an embodiment of a color liquid crystal display apparatus using a variable display duty scheme in a manual manner in combination with three primary color-planar sequential scheme.

FIG. 5A is a block diagram of a color liquid crystal display apparatus using a combination of variable display duty scheme in manual mode with three primary color-planar sequential scheme according to this embodiment.

Referring to FIG. 5A, the color liquid crystal display apparatus includes a synchronizing signal (V-Sync) input terminal 501; a R-signal input terminal 502; a G-signal input terminal 503; a B-signal input terminal 504; A/D converters 505,506 and 507 for the R, G and B signals, respectively; a minimum value detection circuit 508 an extraction rate modulation trimmer 509, a level correction circuit 510, a P/S conversion time-division circuit 511, a memory 512, a color filter-less liquid crystal display device 513, and a light source unit 514.

Figure 5B:
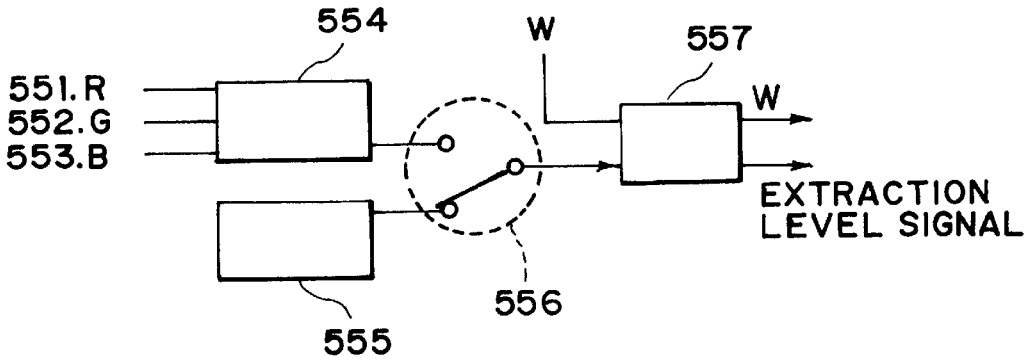
FIG. 5B is ia block diagram of a part of a color liquid crystal display apparatus including an automatic/manual mode selector switch for allowing selection of extracted level signals inputted a level correction circuit shown in FIG. 5A.
Figure 6B:
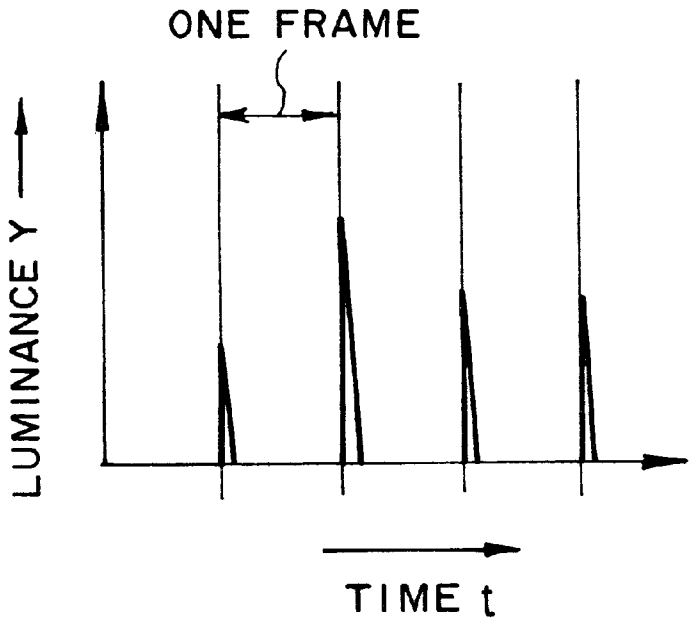
FIG. 6A shows a light emission state at a pixel of a hold-type liquid crystal display apparatus and FIG. 6B shows a light emission state at a pixel of a impulse-type CRT.
Figure 6A:
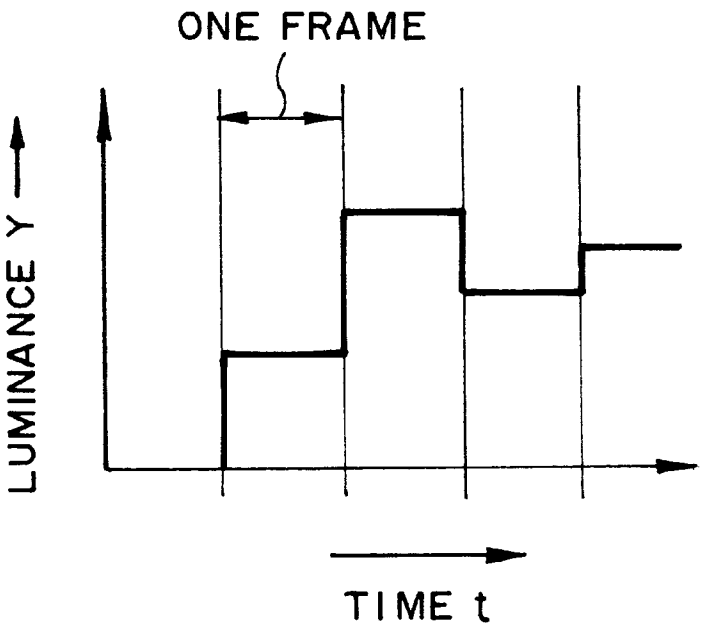

FIG. 5B illustrates an automatic/manual mode selector switch system for allowing selection of extracted level signals inputted into the level correction circuit shown in FIG. 5A.

Referring to FIG. 5B, the system includes an R-signal input terminal 551, a G-signal input terminal 552, a B-signal input terminal 553, a motion detection circuit 554, an extraction rate modulation trimmer 555, an automatic/manual mode selector switch 556 and a level correction circuit 557.

In this embodiment, in place of the luminance and motion detection circuit 208 as shown in FIG. 2 (Second Embodiment), the extraction rate modulation trimmer 509 (mode selector trimmer) as modulation means is provided. As a result, it is possible to modulate the extraction rate of color-mixing signals in an extraction level modulation circuit, e.g., at three levels, whereby the user can appropriately select a motion image mode with clearness, a motion image and power saving mode, and a power saving mode while suppressing production costs.

Further, as shown in FIG. 5B, in this embodiment, both the automatic mode wherein the extraction rate of color-mixing signals is determined by judging the image as to whether the image is motion image or still image from the inputted digital color image signals an the manual mode wherein the extraction rate of color-mixing signals is modulated by adjusting the modulation trimmer are provided to the color liquid crystal display apparatus. Further, the automatic/manual mode selector switch 556 is provided, thus allowing selection of extraction level signals respectively inputted into the level correction circuit 510 shown in FIG. 5A.

As a result, the user can appropriately select the motion image mode with clearness and the power saving mode as desired.

As described hereinabove, according to the liquid crystal display apparatus and driving method therefor of the present invention, by using a combination of a liquid crystal panel and a light source, motion image display is performed in a non-hold mode for images with higher luminance and higher contrast liable to provide bluntness and poor clearness at image edges by decreasing a display duty. Further, a display duty is modulated depending on respective images to be displayed, whereby it is possible to reduce the power consumption while retaining clearness of motion images.

Further, according to the present invention, the liquid crystal display apparatus is provided with a mode selector trimmer, thus allowing modulation of color-mixing signal extraction rate, e.g., at three levels. As a result, it becomes possible for the user to select, as desired, a clear motion image mode, a motion image and power saving mode, and a power saving mode.

Further, the driving method for liquid crystal display apparatus of the present invention is provided with an automatic mode determining a color-mixing signal extraction rate through judgment of inputted image as to where the image is motion image or still image based on inputted digital color image signals and a manual mode modulating the color-mixing signal extraction rate by trimmer adjustment, together with an automatic/manual selector switch. As a result, it becomes possible to select extraction level signals respectively inputted into a level correction circuit, thus allowing the user to appropriate select a cleaner motion image mode and a power saving mode.

What is claimed is:

1. A liquid crystal display apparatus comprising:

a liquid crystal display device for displaying an image from an inputted digital image signal in a succession of frame periods;

a light source capable of emitting light while changing a lighting duty in a frame period; and motion detection means for detecting whether the inputted digital image signal is for a still image or a motion image.

wherein the lighting duty of said light source is set depending on a result of the detection performed by said motion detection means, wherein said motion detection means comprises a luminance detection means for detecting a luminance level of the inputted digital image signal and for comparing an average luminance level over an entire picture area of said liquid crystal display device with a luminance level at a portion where the motion image is detected, wherein the lighting duty of said light source is set to a prescribed value based on a result of comparison by the luminance detection means.

wherein said liquid crystal display device displays the image in a frame period divided into three field periods when the inputted digital image signal is for a still image and in a frame period divided into at least four field periods when the inputted digital image signal is for a motion image, and wherein the lighting duty is set so that the lighting is effected in a set of three field periods consisting of a red field period, a green field period, and a blue field period, and said light source is extinct in the period other than the three field periods.

2. An apparatus according to claim 1, wherein the lighting duty of said light source is set to 100% when said motion detection means detects the inputted digital image signal as the still image and is set to a lower value when said motion detection means detects the inputted digital image signal as the motion image.

3. An apparatus according to claim 1, wherein the lighting duty is set to a lower value with a larger change in luminance between the average luminance level and the luminance level at the portion where the motion image is detected.

4. An apparatus according to claim 1, wherein said liquid crystal display device is free from a color filter, and said light source is capable of emitting three primary colors in synchronism with said liquid crystal display device, and wherein said liquid crystal display apparatus effects a color display according to a field-sequential color scheme in which one frame (a) includes a display period for switching respective colors of the primary colors of said light source in a time sequential manner, and (b) is divided into a plurality of fields for controlling transmission of said liquid crystal display device in synchronism with the switching of the colors of said light source, thereby effecting color display based on a time-wise additive process.

5. An apparatus according to claim 1, further comprising a selecting means wherein said selecting means effects switching between an automatic mode for determining the lighting duty by judgement as to a still image and a motion image based on the inputted digital image signal by said motion detection means, and a manual mode for changing the lighting duty by adjusting the modulation means.

6. An apparatus according to claim 1, wherein said light source provides a constant time-integrated luminance in each frame period over the succession of frame periods regardless of the change in lighting duty.

* * * * *

UNITED STATES PATENT AND TRADEMARK OFFICE

CERTIFICATE OF CORRECTION

PATENT NO. : 6,791,527 B2
DATED : September 14, 2004
INVENTOR(S) : Hideki Yoshinaga et al.

It is certified that error appears in the above-identified patent and that said Letters Patent is hereby corrected as shown below:

Drawings,
Fig. 7A, "WHIT" should read -- WHITE --.

Column 1,
Line 23, "that" should be deleted;
Line 24, "quick a" should read -- a quick --; and
Line 50, "(chandani," should read -- (Chandani, --.

Column 2,
Line 27, "Red" should read -- R --.

Column 3,
Lines 16 and 23, "judder" should read -- jitter --.

Column 7,
Line 35, "comprises" should read -- comprise --.

Column 8,
Line 26, "is" should read -- are --.

Signed and Sealed this

Eighteenth Day of January, 2005

JON W. DUDAS
*Director of the United States Patent and Trademark Office*